US009518779B2

(12) United States Patent
Favaro

(10) Patent No.: US 9,518,779 B2
(45) Date of Patent: Dec. 13, 2016

(54) DRYING PLANT FOR PARTICULATE MATERIALS

(71) Applicant: GARBUIO S.p.A., Paese (IT)

(72) Inventor: Mansueto Favaro, Treviso (IT)

(73) Assignee: GARBUIO S.P.A. (IT)

( * ) Notice: Subject to any disclaimer, the term of this patent is extended or adjusted under 35 U.S.C. 154(b) by 67 days.

(21) Appl. No.: 14/678,122

(22) Filed: Apr. 3, 2015

(65) Prior Publication Data

US 2015/0285554 A1 Oct. 8, 2015

(30) Foreign Application Priority Data

Apr. 4, 2014 (IT) ..... TV14A0053

(51) Int. Cl.
*F26B 3/08* (2006.01)
*A24B 3/04* (2006.01)

(52) U.S. Cl.
CPC . *F26B 3/08* (2013.01); *A24B 3/04* (2013.01); *F26B 2200/22* (2013.01)

(58) Field of Classification Search
CPC ..... F26B 1/00; F26B 3/00; F26B 3/08; A24B 5/00; A24B 3/00; A24B 3/04
USPC ..... 34/173, 184; 131/296, 304
See application file for complete search history.

(56) References Cited

U.S. PATENT DOCUMENTS 4,070,765 A * 1/1978 Hovmand ..... B01J 2/04 34/371
4,494,556 A * 1/1985 Wu ..... A24B 3/04 131/302
4,506,682 A * 3/1985 Muller ..... A24B 15/24 131/297

(Continued)

FOREIGN PATENT DOCUMENTS

DE 10046123 3/2002
DE 102006024936 10/2007

(Continued)

OTHER PUBLICATIONS

Corresponding Italian Search Report,dated Dec. 1, 2014 for IT Application No. TV20140053.

*Primary Examiner* — Stephen M Gravini
(74) *Attorney, Agent, or Firm* — The Belles Group, P.C.

(57) ABSTRACT

Drying plant for particulate materials comprising: a drying duct which is provided with a substantially horizontal rectilinear starting section, a rectilinear ascending final section which extends upwards with a predetermined angle of inclination with respect to the vertical, and a curved intermediate section which connects the rectilinear starting section to the rectilinear final section; a hot gas generator designed for supplying to the inlet of the rectilinear starting section of the drying duct a flow of process gas at high temperature; a particulate feeding device which is structured so as to be able to feed/introduce into the rectilinear starting section of the drying duct a flow of particulate material to be (Continued)

dried substantially without relevant leaks of process gas from the drying duct; and a bypass duct which branches from the rectilinear starting section of the drying duct upstream of the particulate feeding device, and then re-joins the drying duct at the curved intermediate section, so as to feed back into the drying duct the process gas diverted inside it.

19 Claims, 2 Drawing Sheets

(56) References Cited

U.S. PATENT DOCUMENTS 4,697,604 A * 10/1987 Brown ..... A24B 3/182 131/296
4,806,279 A * 2/1989 Ramm ..... B01F 11/0077 100/38
4,984,374 A * 1/1991 Bird ..... A24B 3/04 34/557
5,658,142 A * 8/1997 Kitchen ..... F26B 1/00 432/58
6,148,541 A * 11/2000 Favaro ..... A24B 3/04 34/168
6,185,843 B1 * 2/2001 Stone ..... A24B 3/04 131/290
6,249,988 B1 * 6/2001 Duske ..... F26B 11/028 122/422
6,256,902 B1 * 7/2001 Flaherty ..... F26B 17/105 110/222
6,397,851 B1 * 6/2002 Pluckhahn ..... A24B 3/182 131/290
7,771,690 B2 * 8/2010 Vandendoren ..... C01D 7/126 423/427
8,117,764 B2 * 2/2012 Ness ..... C10L 9/08 110/346
8,522,793 B2 * 9/2013 Ohdaka ..... A24B 3/04 131/296
2005/0223589 A1 10/2005 Funke et al.
2010/0156104 A1 * 6/2010 Bottinelli ..... C01B 3/12 290/52
2014/0369155 A1 * 12/2014 Meeker ..... B28C 5/003 366/4
2015/0285554 A1 * 10/2015 Favaro ..... A24B 3/04 34/576
2016/0091246 A1 * 3/2016 Nordahl ..... F26B 3/08 34/384

FOREIGN PATENT DOCUMENTS

EP 1584246 10/2005
IT EP 2123179 A1 * 11/2009 ..... A24B 3/06
IT WO 2010094913 A2 * 8/2010 ..... F26B 17/107
WO 2014044358 10/2007

* cited by examiner

DRYING PLANT FOR PARTICULATE MATERIALS

CROSS-REFERENCE TO RELATED APPLICATIONS

The present application claims priority under 35 U.S.C. §119 to Italian Patent Application No. TV2014A000053, filed Apr. 4, 2014, the entirety of which is incorporated herein by reference.

FIELD OF THE INVENTION

The present invention concerns a drying plant for particulate materials.

More in detail the present invention concerns a drying plant for the rapid drying of cut tobacco, use to which the following description will make explicit reference without loss of generality.

BACKGROUND OF THE INVENTION

As is known, plants for the rapid drying of cut tobacco use a process gas with temperature higher than 200° C., to rapidly evaporate the water contained in the particles of cut tobacco.

More in detail, the majority of these drying plants are provided with a long straight drying duct arranged vertically, traditionally called "drying column", inside which a more or less constant flow of process gas is made to flow upwards with a given quantity of suspended cut tobacco particles per unit of volume, so as to cause rapid drying of the tobacco particles as they ascend the duct; and a big cyclone filter, which is connected to the upper end of the drying duct so as to receive at the inlet the process gas with the particles of tobacco in suspension, and is structured so as to cause precipitation of the particles of cut tobacco onto the bottom of the cyclone filter, discharging the process gas from an outlet usually located on the top of the cyclone filter.

More specifically, in this type of drying plant, the process gas is fed to the inlet of the drying duct by a hot gas generator, which is usually structured so as to suck the process gas from the cyclone filter, heat it to a temperature higher than 200° C., and lastly pump it back to the inlet of the vertical drying duct.

The particles of cut tobacco are fed into the flow of process gas immediately upstream of the vertical drying duct, by means of a star valve which is usually located at the lower end of the drying duct, and is structured so as to be able to introduce into the drying duct a more or less constant flow of particles of cut tobacco, without causing discharge of the process gas from the drying duct.

The bottom of the cyclone filter is provided with a second star valve which allows extraction of the particles of cut tobacco from the cyclone filter, without discharging the process gas from the cyclone filter.

Since the quantity of water extracted from the tobacco particles is a function of the residence time of the particles in contact with the high-temperature process gas, and the height of the "drying column" cannot be greater than the maximum height of the warehouse in which the drying plant is installed, in recent years some manufacturers of plants for rapid drying of cut tobacco have begun to use drying ducts provided with a short rectilinear starting section which extends parallel to the ground, and to locate the star valve along the horizontal rectilinear section of the drying duct.

In this way, the particles of cut tobacco remain in contact with the process gas for the entire length of the vertical rectilinear section and also for all or part of the horizontal rectilinear section of the drying duct, with all the resulting advantages.

Unfortunately, while allowing a significant increase in the working length of the drying duct, the presence of the 90° bend on the duct causes anomalous distribution of the particles of cut tobacco in the flow of process gas which ascends the vertical section of the drying duct, at least partly thwarting the advantages due to the increased working length of the drying duct.

Experimental tests, in fact, have shown that, downstream of the bend, the particles of cut tobacco tend to stratify close to the wall of the duct which is arranged outside the bend, locally increasing the density of particles per unit of volume beyond the maximum limits admissible for optimal drying of the particles of cut tobacco.

In addition, at the bend, the particles of cut tobacco tend to knock violently against the wall of the duct depositing on the surface tar-based oily residues which, over time, stratify on the surface of the wall, forming scale which further worsens the distribution of the particles of cut tobacco along the vertical section of the drying duct, and furthermore progressively reduces the free section of the drying duct, compromising correct operation of the drying plant in the long term.

SUMMARY OF THE INVENTION

Aim of the present invention is to eliminate the drawbacks due to the presence of the bend along the drying duct of the cut tobacco drying plant.

In compliance with the above aims, there is provided a drying plant for particulate materials as defined in claim 1.

BRIEF DESCRIPTION OF THE DRAWINGS

The present invention will now be described with reference to the accompanying drawings, which illustrate a non-limiting embodiment example thereof, in which:

FIG. 1 is a schematic view of a drying plant for the rapid drying of cut tobacco realized according to the teachings of the present invention; whereas

DETAILED DESCRIPTION OF THE INVENTION

Figure 1:
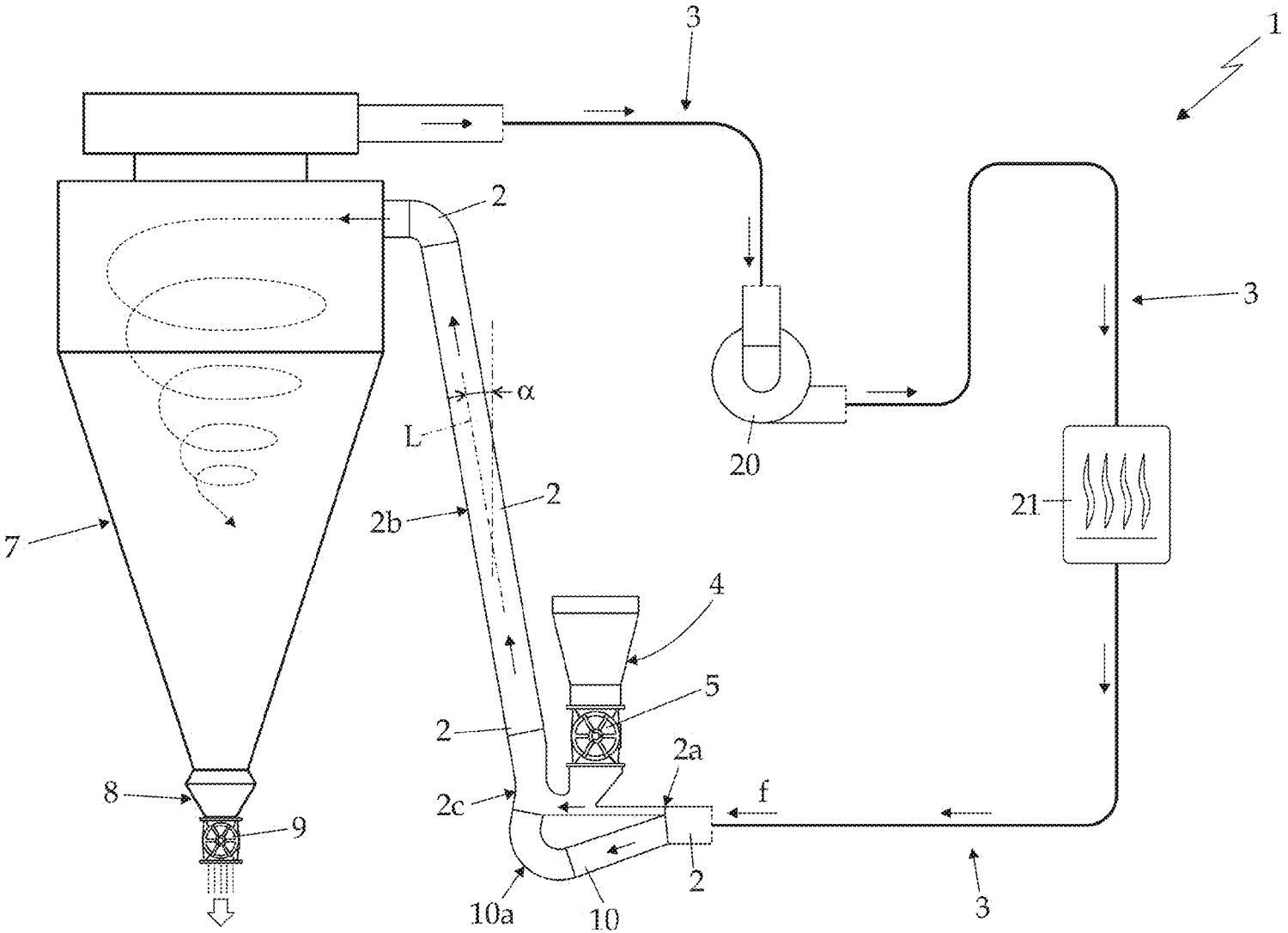
Figure 2:
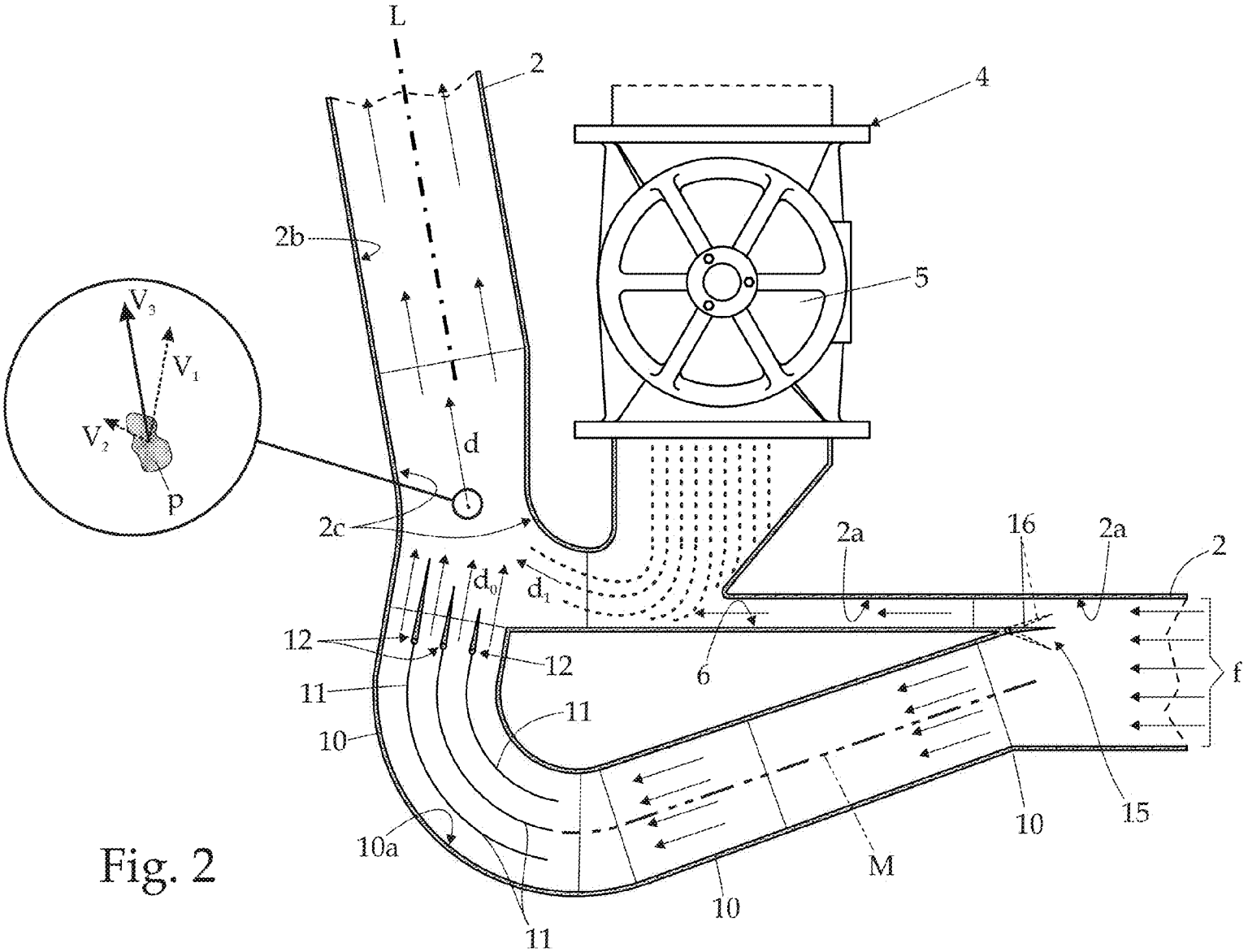
FIG. 2 is a section view of a part of the drying plant shown in FIG. 1.

With reference to FIGS. 1 and 2, number 1 indicates as a whole a drying plant for particulate materials, which can be advantageously used for the rapid drying of cut tobacco.

The drying plant 1 firstly comprises a long drying duct 2 preferably with square or rectangular section, which is provided with a substantially rectilinear starting section 2*a* extending substantially parallel to the ground, i.e. horizontally; a final substantially rectilinear ascending section 2*b* extending upwards with an angle of inclination $\alpha$ with respect to the vertical preferably ranging between 0° and 30°; and an intermediate curved section 2*c* joining/connecting the rectilinear starting section 2*a* to the final rectilinear section 2*b*.

In the example shown, in particular, the final section 2*b* of the drying duct 2 has an angle of inclination $\alpha$ with respect to the vertical preferably, though not necessarily, equal to approximately 10°. Preferably the length of the final rectilinear section 2*b* of the drying duct 2 is furthermore greater than the length of the rectilinear starting section 2*a*.

The drying plant 1 furthermore comprises a hot gas generator 3 which is connected to the mouth of the starting section 2*a* of the drying duct 2, and is structured so as to be able to supply to the inlet of the drying duct 2 a more or less constant, and preferably also adjustable, flow f of a high-temperature process gas, preferably superheated air, which has a temperature higher than 150° C. and preferably, though not necessarily, ranging between 200° C. and 250° C.; and a particulate feeding device 4, which is located along the starting section 2*a* of the drying duct 2, at a predetermined distance from the intermediate curved section 2*c*, and is structured so as to be able to feed/introduce, into the drying duct 2, a more or less constant and preferably also adjustable flow of particulate material to be dried, substantially without relevant/significant leaks of process gas from the drying duct 2.

In other words, the particulate feeding device 4 is located upstream of the intermediate curved section 2*c*, at a predetermined distance from the latter.

In this way, the flow of high-temperature process gas that flows along the drying duct 2 carries in suspension a predetermined, and preferably also adjustable, quantity of particles of particulate material per unit of volume. Particles that, during ascent along the drying duct 2, rapidly dry remaining in direct contact with the process gas.

More in detail, the particulate feeding device 4 is preferably structured so as to be able to feed/introduce, into the drying duct 2, a more or less constant and adjustable flow of particles of cut tobacco, so that the drying duct 2 is crossed by a more or less constant flow of process gas with a given quantity of suspended particles of cut tobacco per unit of volume. Particles of cut tobacco that rapidly dry during ascent along the final ascending section 2*b* of the drying duct 2.

In the example shown, in particular, the particulate feeding device 4 comprises a star valve 5 that communicates with the inside of drying duct 2, and is structured so as to be able to selectively feed/introduce by gravity a continuous succession of minimum quanta/doses of particles of cut tobacco into the drying duct 2 with a predetermined adjustable frequency, without relevant/significant leaks of process gas from the drying duct 2.

In addition, the star valve 5 communicates with the inside of the drying duct 2 at a distance from the intermediate curved section 2*c* preferably greater than one meter and preferably, though not necessarily, ranging between 1 and 4 m (meters).

Preferably, the rectilinear starting section 2*a* of the drying duct 2 is moreover structured so as to produce/generate, at the particulate feeding device 4, or better at the star valve 5, a sudden decrease in the pressure of the process gas, which tends to suck the particulate material, i.e. the particles of cut tobacco, towards the curved intermediate section 2*c* of the drying duct 2.

In other words, the rectilinear starting section 2*a* of the drying duct 2 is structured so as to trigger, at the star valve 5, a Venturi effect which tends to suck the particulate materials, i.e. the particles of cut tobacco, towards the curved intermediate section 2*c* of the drying duct 2.

More in detail, with particular reference to FIG. 2, in the example shown the portion 6 of the rectilinear starting section 2*a* of the drying duct 2 arranged at the star valve 5, is preferably provided with a convergent-divergent profile able to trigger a Venturi effect in the process gas that flows along the rectilinear starting section 2*a* of drying duct 2.

With reference to FIG. 1, in addition the drying plant 1 also comprises a big centrifugal dust separator 7, which is connected to the mouth of the final section 2*b* of the drying duct 2 so as to receive at the inlet the process gas with the particles of particulate material in suspension, and is structured so as to make the particles of particulate material precipitate therein, while discharging the process gas from a gas outlet.

More in detail, the drying plant 1 comprises a big cyclone filter 7 which is connected to the upper mouth of the final section 2*b* of the drying duct 2 so as to receive at the inlet the process gas with the particles of particulate material in suspension, and is structured so as to make the particles of particulate material precipitate onto the bottom of the cyclone filter 7, while discharging the process gas from a gas outlet preferably located on the top of the cyclone filter 7.

In the example shown, in particular, the cyclone filter 7 is connected to the mouth of the rectilinear final section 2*b* of the drying duct 2 so as to receive at the inlet the process gas with the particles of cut tobacco in suspension, and is structured so as to make the particles of cut tobacco precipitate onto the bottom of the cyclone filter 7.

The cyclone filter 7 is furthermore provided with a particulate extraction device 8 which is preferably located on the bottom of said cyclone filter 7, and is structured so as to allow extraction/removal from the cyclone filter 7 of the particles of particulate material that deposit on the bottom of cyclone filter 7, substantially without relevant leaks of process gas from the cyclone filter 7.

More in detail, the particulate extraction device 8 is preferably structured so as to extract/remove a more or less constant flow of particles of particulate material, or better of particles of cut tobacco, from the cyclone filter 7 without relevant leaks of process gas from the cyclone filter 7.

In the example shown, in particular, the particulate extraction device 8 comprises a star valve 9 which is located at the dust outlet present on the bottom of the outer casing of cyclone filter 7, and is structured so as to be able to selectively extract/remove by gravity a continuous succession of minimum amounts/doses of particles of cut tobacco from the bottom of the cyclone filter 7, with predetermined adjustable frequency, without relevant leaks of process gas from the cyclone filter 7.

Preferably, the quantity of particles of cut tobacco per unit of time that the particulate extraction device 8 is able to extract/remove from the cyclone filter 7 is furthermore substantially equal to the quantity of particles of cut tobacco per unit of time which the particulate feeding device 4 is able to feed/introduce into the drying duct 2.

With reference to FIGS. 1 and 2, the drying plant 1 is furthermore provided with a bypass duct 10 preferably with square or rectangular section, which branches from the rectilinear starting section 2*a* of the drying duct 2 upstream of the particulate feeding device 4, i.e. upstream of the star valve 5, so as to intercept and divert inside it a part of the flow of process gas entering in the drying duct 2; and then rejoins the drying duct 2 at the intermediate curved section 2*c*, and therefore downstream of the particulate feeding device 4, so as to feed back into the drying duct 2 the process gas that flows within itself.

More in detail, the bypass duct 10 connects/joins to the intermediate curved section 2*c* of the drying duct 2 preferably at the wall of drying duct 2 arranged outside the bend, i.e. at the wall of drying duct 2 having the greatest radius of curvature.

The bypass duct 10 is furthermore structured so as to feed, at the confluence/intersection with the intermediate curved section 2*c*, the process gas into the drying duct 2 in a direction $d_0$ which is inclined with respect to the direction $d_1$ of the flow of process gas arriving from the rectilinear starting section 2*a* of the drying duct 2 by a predetermined angle greater than 0°.

More in detail, the bypass duct 10 is structured so as to feed, at the confluence/intersection with the intermediate curved section 2*c*, the process gas into the drying duct 2 so as to push upwards the particles p of particulate material which are in suspension in the flow of process gas that flows along the rectilinear starting section 2*a* of the drying duct 2, in a predetermined direction. Preferably the direction d is furthermore locally substantially parallel to the longitudinal axis L of the final section 2*b* of drying duct 2.

With particular reference to FIG. 2, in the example shown, in particular, the terminal part of the bypass duct 10 is preferably structured so as to feed the process gas into the intermediate curved section 2*c* in a direction $d_0$ which is inclined with respect to the vertical by an angle preferably ranging between 0° and 45°, and which is preferably oriented so that the sum of the velocity vector $V_1$ of the process gas arriving from the bypass duct 10 and the velocity vector $V_2$ of the process gas arriving from the starting section 2*a* of drying duct 2 gives rise to a velocity vector $V_3$ oriented so as to be locally substantially parallel to the longitudinal axis L of the final section 2*b* of drying duct 2.

In this way, the particles p of cut tobacco in suspension in the process gas arriving from the rectilinear starting section 2*a* of the drying duct 2, change direction before impacting on the wall of the drying duct 2, and move towards the final rectilinear section 2*b* of drying duct 2 with a velocity vector $V_3$ which is locally substantially parallel to the longitudinal axis L of the rectilinear final section 2*b*.

With reference to FIG. 2, in the example shown, in particular, the bypass duct 10 is preferably arranged substantially coplanar with the rectilinear starting section 2*a*, with the rectilinear final section 2*b* and with the intermediate curved section 2*c* of the drying duct 2. Preferably the bypass duct 10 furthermore joins/merges/connects to the intermediate curved section 2*c* of drying duct 2, at the end of a curved section 10*a* which is structured so as to feed the process gas into the intermediate curved section 2*c* in a direction $d_0$ which is inclined with respect to the vertical of an angle preferably ranging between 0° and 45°.

With reference to FIG. 2, in addition inside the bypass duct 10 there preferably located are one or more longitudinal septums 11 (three longitudinal septums in the example shown) which extend parallel to the centerline M of the bypass duct 10, and are orthogonal to the lying plane of the bypass duct 10.

More in detail, the longitudinal septums 11 are preferably located in the curved section 10*a* of the bypass duct 10.

Preferably, the drying plant 1 is moreover provided with one or more movable flow deflector devices 12 each of which is located inside the bypass duct 10, at the intersection with the intermediate curved section 2*c* of the drying duct 2, and is structured so as to be able to vary, as a function of its own position, the direction of the process gas entering the intermediate curved section 2*c* of drying duct 2.

In other words, the flow deflector device(s) 12 are structured so as to be able to regulate the value of the angle of inclination with respect to the vertical of the direction $d_0$ of the flow of process gas that comes out of the bypass duct 10 and feeds into the intermediate curved section 2*c* of the drying duct 2.

With reference to FIG. 2, in the example shown, in particular, each flow deflector device 12 preferably comprises a preferably substantially airfoil-shaped, plate-like element which is arranged inside the bypass duct 10 locally substantially orthogonal to the lying plane of the bypass duct 10 and/or of the intermediate curved section 2*c* of the drying duct 2, and is flag-hinged to the walls of the bypass duct 10 so as to be able to rotate inside the bypass duct 10 about a reference axis which is locally orthogonal to the lying plane of the bypass duct 10 and/or of the intermediate curved section 2*c*.

In addition, the flow deflector device 12 preferably also comprises a manually-operated or motorised, command member (not shown) which is mechanically connected to the plate-like element, and is structured so as to be able to vary the angle of inclination of the plate-like element with respect to the centerline M of the bypass duct 10.

More in detail, in the example shown, the airfoil-shaped plate-like element of each flow deflector device 12 is located inside the bypass duct 10, at the back of the lateral edge of a respective longitudinal septum 11, so as to be able to vary the angle of inclination with respect to the same longitudinal septum 11.

With reference to FIG. 2, the drying plant 1 is lastly provided also with an airflow control device 15 which is located inside the bypass duct 10 and/or inside the starting section 2*a* of drying duct 2, and is structured so as to be able to regulate the flow rate of the process gas flowing along the bypass duct 10, and/or the flow rate of the process gas which flowing along the converging-diverging profile portion 6 of the starting section 2*a* of drying duct 2, i.e. the part of the starting section 2*a* of drying duct 2 located downstream of the branch.

More in detail, the airflow control device 15 is preferably located at the point in which the bypass duct 10 branches from the rectilinear starting section 2*a* of drying duct 2, and is preferably structured so as to be able to distribute, in adjustable manner, the flow f of process gas entering into the drying duct 2, between the bypass duct 10 and the remaining part of the rectilinear starting section 2*a* of drying duct 2.

In the example shown, in particular, the airflow control device 15 preferably comprises an airfoil-shaped plate-like element 16 which is located inside the drying duct 2, at the point in which the bypass duct 10 branches from the rectilinear starting section 2*a* of drying duct 2, so as to be locally substantially orthogonal to the lying plane of bypass duct 10 and of the rectilinear starting section 2*a* of drying duct 2, and is flag-hinged to the walls of the drying duct 2, so as to be able to rotate inside the drying duct 2 about a transversal reference axis which is locally orthogonal to the lying plane of the rectilinear starting section 2*a* of drying duct 2 and of the bypass duct 10.

In addition the airflow control device 15 preferably also comprises a manual-operated or motorized command member (not shown) which is mechanically connected to the plate-like element 16, and is structured so as to be able to vary the angle of inclination of the plate-like element 16 with respect to the vertical, so as to direct, in an adjustable manner, the flow f of process gas entering into the drying duct 2, more towards the bypass duct 10, or more towards the remaining part of the rectilinear starting section 2*a* of drying duct 2.

With reference to FIG. 1, in the example shown, lastly, the hot gas generator 3 is preferably, though not necessarily, structured so as to suck the process gas from the cyclone filter 7, heat the process gas to a temperature higher than 150° C. and preferably ranging between 200° C. and 250° C., and lastly pump the heated process gas at the inlet to the starting section 2*a* of drying duct 2.

More in detail, in the example shown the hot gas generator 3 preferably comprises: a circulation pump 20 which is connected to the gas outlet of the cyclone filter 7, so as to be able to suck the process gas from the cyclone filter 7; a heater device 21 which is structured to release heat to the process gas that flows through said heater device 21, thus increasing the temperature thereof; and lastly a series of connecting pipes that connect the delivery of the circulation pump 20 to the heater device 21, and the heater device 21 to the mouth of the rectilinear starting section 2*a* of drying duct 2, so as to convey the process gas flowing out of the circulation pump 20 back to the mouth of the rectilinear starting section 2*a* of the drying duct 2 after passing inside the heater device 21.

Preferably, though not necessarily, the heater device 21 furthermore consists of an air/liquid exchanger or a gas burner.

Operation of drying plant 1 can be easily inferable from what described above and does not require further explanations.

The advantages associated with the presence of the bypass duct 10 are considerable.

Firstly, the flow of process gas that the bypass duct 10 feeds into the curved intermediate section 2*c* of drying duct 2 allows uniform distribution of the particles of cut tobacco along the entire section of the rectilinear final section 2*b* of drying duct 2, enormously improving the efficiency of the drying process of the particles of cut tobacco.

Furthermore, the introduction of the process gas at the curved intermediate section 2*c* of drying duct 2 prevents the particles of cut tobacco from knocking against the wall of the drying duct 2, avoiding the formation of scale and, even more important, avoiding excessive pulverization of the particles of cut tobacco due to the impact with the wall of the drying duct 2.

Lastly it is clear that modifications and variations can be made to the drying plant 1 described above without departing from the scope of the present invention.

For example, in a different embodiment the airflow control device 15 may comprise a shutter valve located inside the bypass duct 10, and/or a shutter valve located inside the rectilinear starting section 2*a* of drying duct 2 arranged downstream of the point at which the bypass duct 10 branches from said rectilinear starting section 2*a*.

What is claimed is:

1. A drying plant for particulate materials comprising: an ascending drying duct, a hot gas generator designed for supplying to the inlet of the drying duct a flow of high-temperature process gas, and a particulate feeding device structured so as to be able to feed into the drying duct a flow of the particulate material to be dried substantially without relevant leaks of process gas from the drying duct;

wherein the drying duct has a substantially rectilinear and substantially horizontal starting section, a substantially rectilinear ascending final section extending upward with a predetermined angle of inclination with respect to the vertical, and an intermediate curved section that connects the starting section to the final section;

wherein the hot gas generator is connected to the mouth of the starting section of the drying duct;

wherein the particulate feeding device is located along the starting section of the drying duct, at a predetermined distance from the curved intermediate section; and in that wherein it also comprises a bypass duct that branches from the starting section of the drying duct upstream of the particulate feeding device, and then rejoins the drying duct at the intermediate curved section, so as to feed the process gas that flows therein back into the drying duct.

2. Drying plant according to claim 1, wherein the bypass duct connects/joins to the intermediate curved section of the drying duct at the wall of the drying duct arranged outside of the bend.

3. Drying plant according to claim 1, wherein the bypass duct is structured so as to feed, at the intersection with the intermediate curved section, the process gas into the drying duct in a direction which is inclined by a predetermined angle with respect to the direction of the flow of process gas which arrives from the starting section of the drying duct.

4. Drying plant according to claim 3, wherein the bypass duct is structured so as to feed, at the intersection with the intermediate curved section, the process gas into the drying duct so as to push the particles of particulate material suspended in the flow of process gas upwards in a predetermined direction.

5. Drying plant according to claim 4, wherein the end part of the bypass duct is structured so as to feed the process gas into the intermediate curved section of the drying duct in a direction that is inclined with respect to the vertical by an angle ranging between 0° and 45°.

6. Drying plant according to claim 4, wherein said predetermined direction is locally substantially parallel to the longitudinal axis of the final section of the drying duct.

7. Drying plant according to claim 6, wherein the end part of the bypass duct is structured so as to feed the process gas into the intermediate curved section of the drying duct in a direction that is oriented so that the sum of the velocity vector of the process gas coming from the bypass duct and the velocity vector of the process gas coming from the starting section of the drying duct gives rise to a velocity vector oriented so as to be locally substantially parallel to the longitudinal axis of the final section of the drying duct.

8. Drying plant according to claim 5, wherein the bypass duct connects to the intermediate curved section of the drying duct at the end of a curved portion which is structured so as to feed the process gas into the intermediate curved section in a direction which is inclined with respect to the vertical by an angle ranging between 0° and 45°.

9. Drying plant according to claim 1, wherein the particulate feeding device is located along the starting section of the drying duct, at a distance greater than one meter from the curved intermediate section.

10. Drying plant according to claim 1, wherein the starting section of the drying duct is structured so as to generate, at the particulate feeding device, a sudden decrease in the process-gas pressure which tends to suck the particulate material toward the curved intermediate section of the drying duct.

11. Drying plant according to claim 1, further comprising an airflow control device which is located inside the bypass duct and/or inside the starting section of the drying duct, and is structured so as to be able to regulate the flow rate of the process gas that flows along the bypass duct and/or the flow rate of the process gas that flows along the part of the starting section of the drying duct located downstream of the branch.

12. Drying plant according to claim 1, wherein inside the bypass duct there are located one or more longitudinal septums which extend parallel to the centerline of the bypass duct and are orthogonal to the lying plane of the bypass duct.

13. Drying plant according to claim 1, further comprising one or more movable flow deflector devices each of which is located inside the bypass duct at the intersection with the intermediate curved section of the drying duct, and is structured so as to be able to vary, as a function of its own position, the direction of the process gas entering the intermediate curved section of the drying duct.

14. Drying plant according to claim 1, wherein the ascending final section of the drying duct extends upward with an angle of inclination with respect to the vertical ranging between 0° and 30°.

15. Drying plant according to claim 1, further comprising a centrifugal dust separator which is connected to the mouth of the final section of the drying duct so as to receive at the inlet the process gas with the suspended particles of particulate material, and is structured so as to make the particles of particulate material precipitate therein, while discharging the process gas from a gas outlet.

16. Drying plant according to claim 15, wherein the centrifugal dust separator is a cyclone filter which is connected to the mouth of the final section of the drying duct so as to receive at the inlet the process gas with the suspended particles of particulate material, and is structured so as to cause the particles of particulate material to precipitate on the bottom of the cyclone filter, while discharging the process gas from a gas outlet preferably located on top of the cyclone filter.

17. Drying plant according to claim 16, wherein the cyclone filter is provided with a particulate extraction device which is located on the bottom of the cyclone filter and is structured so as to allow removal, from the cyclone filter, of the particles of particulate material that deposit on the bottom of the cyclone filter substantially without relevant leaks of process gas from the cyclone filter.

18. Drying plant according to claim 1, wherein the hot gas generator is structured so as to supply to the inlet of the drying duct a process gas with a temperature greater than 150° C.

19. Drying plant according to claim 1, wherein the particulate feeding device is structured so as to be able to feed, into the drying duct, a flow of particles of cut tobacco to be dried.

* * * * *